United States Patent [19]

Mako

[11] Patent Number: 4,527,920

[45] Date of Patent: Jul. 9, 1985

[54] PRINT HAMMER FIRING COMPENSATION CIRCUIT FOR PRINTER VELOCITY VARIATION

[75] Inventor: John Mako, Endicott, N.Y.

[73] Assignee: International Business Machines Corporation, Armonk, N.Y.

[21] Appl. No.: 503,915

[22] Filed: Jun. 13, 1983

[51] Int. Cl.[3] ..... B41J 1/20

[52] U.S. Cl. ..... 400/146; 101/111; 400/322

[58] Field of Search ..... 101/111, 93.13, 93.14; 400/146, 322

[56] References Cited

U.S. PATENT DOCUMENTS

| | | | |
|---|---|---|---|
| 3,656,426 | 4/1972 | Potter | 101/93.14 |
| 3,752,069 | 8/1973 | Stiles | 101/111 |
| 3,872,788 | 3/1975 | Palombo | 101/93.14 |
| 3,880,075 | 4/1975 | Bovett et al. | 101/111 |
| 4,275,653 | 6/1981 | Balcavage et al. | 101/93.14 |

OTHER PUBLICATIONS

Meier, "Digital Correction . . . " IBM Technical Disclosure Bulletin, vol. 14, No. 12, pp. 3565–3566, 5/72.

Hryck et al., "Type Belt . . . System" IBM Technical Disclosure Bulletin, vol. 22, No. 8A, pp. 3169–3170, 1/80.

*Primary Examiner*—William Pieprz

*Attorney, Agent, or Firm*—John S. Gasper

[57] ABSTRACT

Circuit for detecting variations in the nominal velocity of a character band and adjusting the hammer firing times to compensate for the variations. This circuit measures deviations in band velocity that are either faster or slower than a nominal velocity during each character emitter pulse and makes an appropriate correction in the subscan times that gate the hammer firing signals. A bidirectional counter is counted up at a high frequency to a value representing the emitter period including the velocity deviation and then counted down after the error determination at a selected frequency that is a preselected fraction of the high frequency. This technique corrects for each character emitter pulse and incorporates a timing proportionality to assure correct hammer impact.

10 Claims, 3 Drawing Figures

EDGE DETECTOR
+V
PR
Q
D
CK
CLR
EMITTER PULSES
CLOCK 10 MHZ
SLOW CLOCK 4 BIT CTR
DECODE
DELAY
MAIN COUNTER 12 BIT
BLOCKING LATCH
HIGH COUNT LIMIT DECODE
ZERO DETECT
DELAY COUNTER 8 BIT
UP
DOWN
CHECK START
DELAY LATCH
DELAY EXTEND LATCH
DISABLE
TO PLL OSC.

PRINT HAMMER FIRING COMPENSATION CIRCUIT FOR PRINTER VELOCITY VARIATION

BACKGROUND OF THE INVENTION

This invention relates generally to high speed impact printers and, more particularly, to a circuit for varying the hammer firing times to compensate for variations in velocity as a character band moves along its path.

Good print registration is highly desirable in achieving quality printing. One of the more common difficulties in maintaining registration is the slight variation in velocity of the type carrying member in high speed printers. This variation, due to poor drive motor regulation or constantly changing impact loading by varying numbers of print hammers, alters the point at which a released hammer impacts its selected character on the type carrier. The flight time of a hammer or impact member after release is relatively constant, but a selected type element can be misplaced to a readily noticeable degree by velocity changes during the hammer flight time when band speeds are nominally hundreds of inches per second. A variation in the nominal band velocity of even one to three percent of nominal velocity results in easily descernible misregistration.

The usual solutions have been to measure the velocity of the type carrying element to determine the velocity error, converting this to a time period, then delaying the hammer firing time by that amount. These measurements required the movement of many type characters past an optical or magnetic sensing transducer so that corrections were determined infrequently and were incapable of immediate effectiveness.

One example of this type of approach is described in the U.S. Pat. No. 3,974,765 in which the elapsed time for the passage of a plurality of type character synchronizing marks is measured and summed with accumulated clock pulses. The accumulated pulses are then compared with the value that should be accumulated if the carrier were going at its nominal velocity. Any difference in count between the actual and nominal totals is then decremented by other clock pulses to provide a delay that is used for the next plurality of characters while a new compensation delay is calculated.

An article from the IBM Technical Disclosure Bulletin entitled "Digital Correction of Hammer Firing Times" by J. H. Meier and J. W. Raider, Volume 14, No. 12, May 1972, pages 3565–6, teaches a similar approach by again using a series of character synchronizing marks to increment clock pulses into an up-down counter. This establishes a value indicative of the belt velocity which switches on a synchronizing signal to cause the counter to decrement downward to zero from the same clock and produce a hammer fire signal. Changes in the maximum count reached, of course, vary accordingly the time to count down to zero.

These techniques also require the provision of an adjustable delay circuit for each hammer. In line printers, this adds significantly to the cost and complexity of the circuits because of the large number of hammers that need to be controlled. If the velocity of the type character band is to be changed radically to provide multiple print speeds, these circuits are not readily adapted to accommodate the change because of the limited ranges of the hammer delay times of which they are capable.

OBJECTS AND SUMMARY OF THE INVENTION

It is accordingly a primary object of this invention to provide a control circuit for a printer having a moving type carrier that is effective to determine the appropriate delay for print hammers at each character emitter pulse and immediately apply that correction.

Another important object of this invention is to provide a circuit that can accommodate both positive and negative changes from the nominal velocity of the moving type carrier and provide the necessary correction for hammer firing to produce improved registration.

A further object of this invention is to provide a circuit for a printer having a moving type carrier in which changes in hammer firing delays can be determined for variations in nominal carrier velocity and which can be readily adapted to different nominal velocities.

A still further object of this invention is to provide a circuit for determining delays for print hammers in a printer having a moving type carrier that is simpler, requires fewer components and is less expensive.

The foregoing objects are attained in accordance with this invention by providing a source of high frequency clock pulses, bi-directional counter means gated to be advanced by said clock pulses during only a final portion of each character timing period by control means, and means including frequency dividing means operable from said clock pulses for decrementing said counter means at a rate required to establish the delay equivalent to the maximum count value in the counter means. When the counter value reaches zero, a signal is generated to initiate operation of a phase lock loop that generates the scan and subscan signals that serve to gate the hammer fire signals.

The disclosed arrangement has several significant advantages: the control means enable the counter means for only the latter portion of each emitter or character timing signal period so that smaller counts are accumulated; the accumulated count can represent variations in the nominal type carrier velocity that indicate either a faster or slower velocity; and since the clock pulses are divided in frequency to provide the decrementing pulses, any dividing ratio can be easily preselected to provide the necessary compensation signal for the velocity variation.

The foregoing and other objects, features and advantages of the invention will be apparent from the following more particular description of preferred embodiments of the invention as illustrated in the accompanying drawing.

DESCRIPTION OF THE PREFERRED EMBODIMENT

Figure 1:
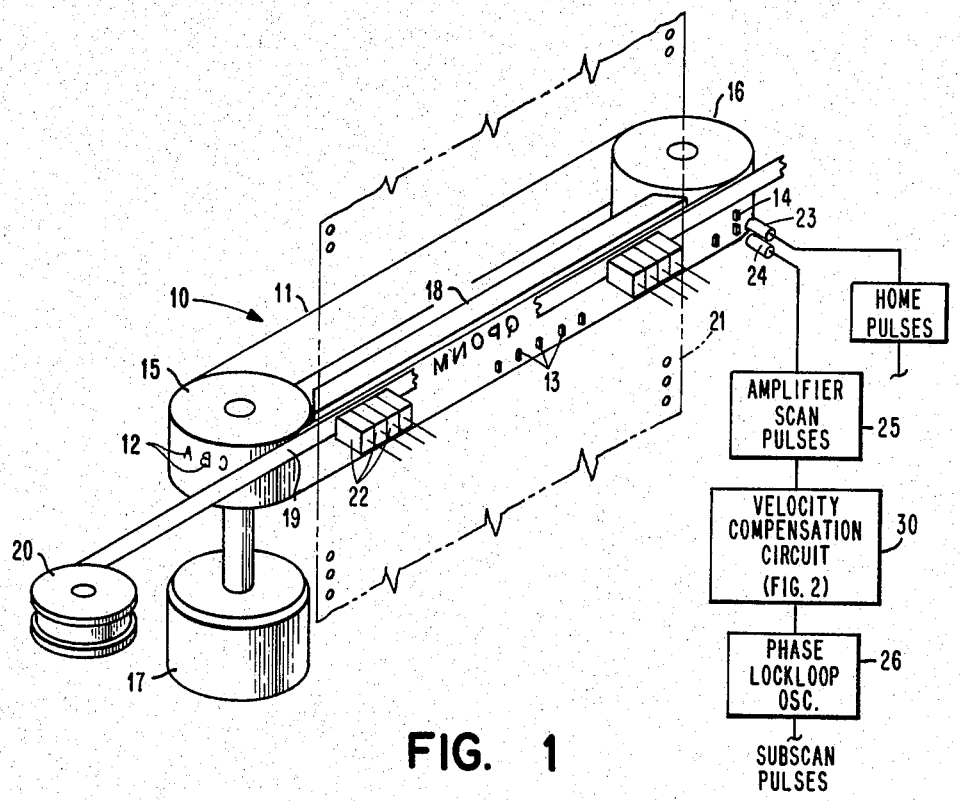
FIG. 1 is a schematic diagram of a type of printer mechanism with which the invention can be used.

Referring to FIG. 1, there is shown a printing mechanism, indicated generally as 10, for which this invention is particularly well-suited. Mechanism 10 comprises generally a moving metal band or belt 11, typically of stainless steel, having type characters 12 and timing marks 13, 14 embossed or etched thereon; the band is supported for rotation about a pair of pulleys 15, 16, one of which is driven by a motor 17. Adjacent one side of band 11 between pulleys 15 and 16 lies a platen 18. Opposite the platen and adjacent the outside surface of band 11 is a horizontally movable ribbon 19 supported on a pair of spools 20, only one of which is shown, and a vertically movable recording medium, such as paper web 21, shown in phantom. Adjacent to the paper web are a plurality of selectively energizable print hammers 22 that can be individually and selectively actuated to impact paper web 21 against ribbon 19 and band 11 and, in turn, against platen 18.

The impacts of the several hammers create an impression of the selected characters on the recording medium. The hammers are energized at appropriate times to produce an impression of the selected character as it comes into position while the band rotates continuously along its path. Ribbon 19 is reversible and also moves continuously in one direction or the other during printing.

The band usually has a plurality of sets of characters formed on its surface and characters are selected for impact by the appropiate hammers by detecting a start or home pulse with transducer 23, which senses timing mark 14, then counting timing or emitter pulses sensed by tranducer 24 sensing timing marks 13. This enables the determination of location of each of the band characters at any time.

Engraved type elements 12, such as alphabetic or numeric characters or other graphic symbols, are uniformally spaced about band 11 but at a pitch which differs from the pitch of hammers 22. Due to this pitch differential, the type characters align as subgroups with subgroups of hammers 22 during band motion in accordance with the plurality of continuously recurring scan and subscan signal sequences. The scan/subscan principle of operation is well-known, and further detailed information can be obtained by reference to U.S. Pat. No. 4,275,653, issued June 30, 1981 to R. D. Bolcavage, et al.

In a particular arrangement in which this invention is practiced, the print mechanism can have 168 print hammers for 168 print positions of a print line to be recorded on print medium 21 with the printed characters spaced 10 to the inch. Type band 11 may have 480 type elements 12 spaced at distances of 0.133 inches, thereby providing four subscans per print scan. With this arrangement, a complete revolution of band 10 would produce 480 scans and 1,920 subscans. Timing marks 13 are equal in number with the type characters and have the same relative, uniform spacing. Therefore, marks 13 are aligned with type characters 12. Transducer 24 in sensing marks 13 produces emitter or scan pulses from amplifier 25. The scan pulses heretofore have then been directly transmitted to a frequency multiplier circuit such as a phase lock loop oscillator circuit 26 to convert the scan pulses to subscan pulses at a frequency equal to the number of subscan alignments of type elements 12 with hammers 22. For the specific pitch differential already mentioned, the phase lock loop oscillator circuit would generate four subscan pulses for each scan pulse generated by transducer 24 in response to each timing mark 13 sensed on band 11.

For printing, the subscan pulses are combined subsequently with clock pulses to perform readouts from a print line buffer and band image buffer, neither of which is shown. Upon coincidence of values at these two units, an equality signal is effective to energize a corresponding hammer fire circuit to print that character. Print hammer selection is explained in greater detail in a patent application entitled "Home Pulse Compensation for Multiple Speed Line Printer" filed June 23, 1982, having Ser. No. 391,313, by J. E. Carrington, et al, and assigned to the same assignee as this invention.

The hammer must be fired in advance of its actual impact point with the band because of the flight time required to move from a retracted position to meet the moving type character at the correct location. Hammer flight time can usually be relied on as being constant so that the time of release in advance of the impact point can be easily calculated for a predetermined band velocity. However, if the velocity of band 11 varies, especially at high speeds, for reasons such as poor drive motor speed regulation or the simultaneous impact by several hammers, then the point of impact between the hammer and type element produce misregistered printing in which adjacent recorded characters are improperly spaced. This variation in nominal band velocity is compensated for by the circuit represented by box 30 interposed between scan pulse amplifier 24 and the phase lock loop oscillator 26 that generates the subscan pulses. Circuit 30 measures the time elapsing between adjacent emitter pulses from sensed timing marks 13 and varies the time at which the oscillator circuit 26 initiates its series of four subscan pulses.

Figure 3:
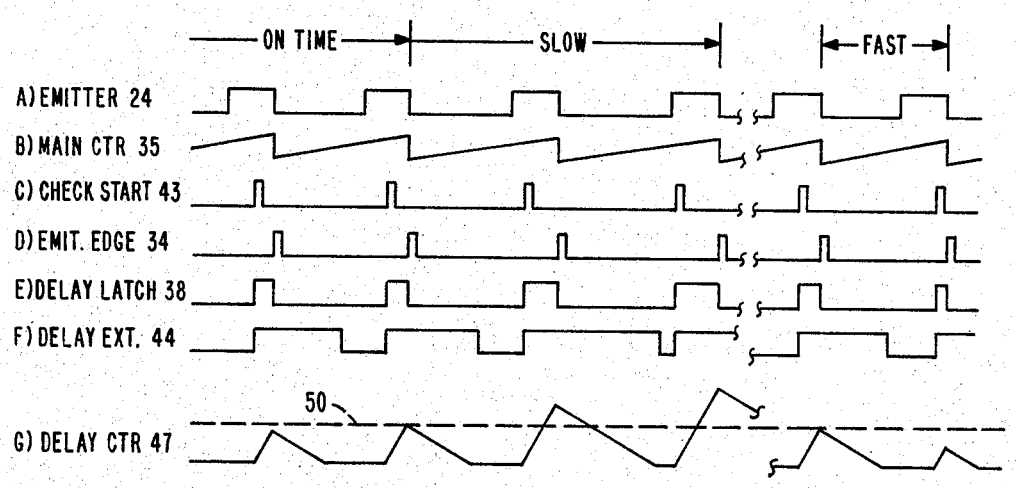
FIG. 3 is a timing diagram of waveforms of selected signals occurring in the circuit shown in FIG. 2.
Figure 2:
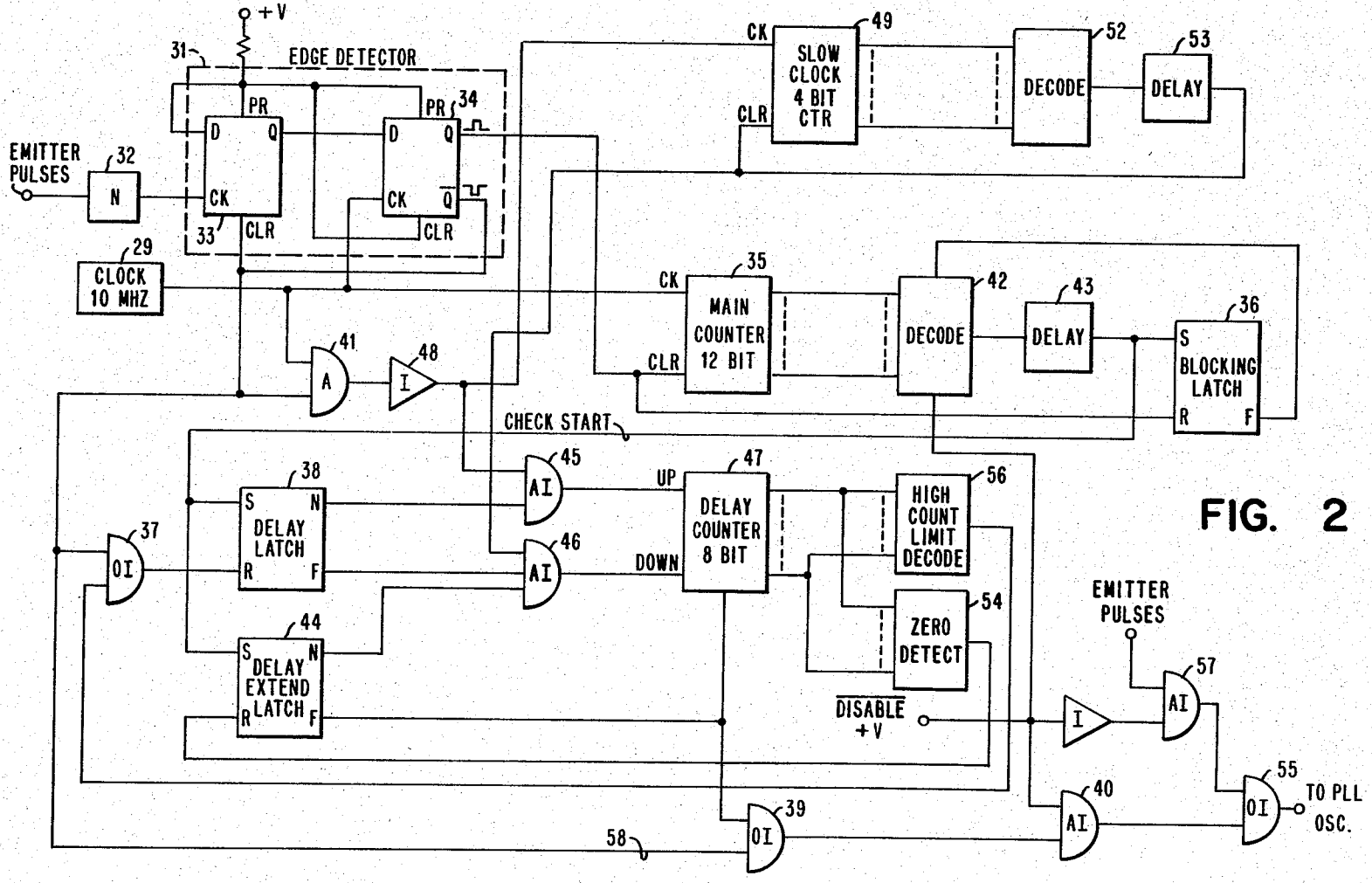
FIG. 2 is a detailed circuit diagram of the compensation circuit of the invention for modifying times during which print hammers can be fired.

Circuit 30 for compensating for variations in the nominal velocity of the band is shown in greater detail in FIG. 2, and related signal waveforms are shown in FIG. 3. An edge detector 31 is used for activating and synchronizing the compensating circuit for each emitter or scan pulse from sensor 24 (FIG. 1). The emitter pulses are fed to inverter 32, whose output is connected to the clock input for flip-flop 33 that is permanently conditioned to turn on. When flip-flop 33 turns on at the falling edge of the emitter pulse, it conditions companion flip-flop 34, which is clocked by signals from a continuous fast clock source 29, such as 10 MHz. The occurrence of one of the latter signals turns on flip-flop 34 and both outputs change. The on output clears main counter 35 to zero and resets blocking latch 36. When the off output from flip-flop 34 simultaneously goes down, it clears flip-flop 33, blocks AND Invert (AI) 41 resets delay latch 38 through OR Invert (OI) 37 and conditions AI gate 40 through OI 39. This latter circuit will be described hereinafter.

The next succeeding clock signal turns flip-flop 34 off conditioning AI gate 41 and the clock signals start advancing main counter 35. The emitter pulses from sensor 24 (FIG. 1) are shown in waveform A, and the resulting signals from edge detector 34 are shown in waveform D of FIG. 3. Main counter 35 advances with the clock signals at the leading edge of the signal from edge detector 34 and the accumulating count produced by the clock signals is shown by the rising slope in waveform B of FIG. 3. Main counter 35 continues accumulating count until decode circuit 42 senses a preset value, at which time an output signal from the decoder occurs through delay 43. This delayed decode signal, identified as a check start signal, blocks further decoding by setting latch 36, sets delay latch 38, and delay extend latch 44 as seen in waveforms E and F of FIG. 3. These two latches when set provide conditioning levels to respective AI gating circuits 45 and 46 which, in turn, respectively enable either the count up or count down inputs of delay counter 47. When AI gate 41 was conditioned by flip-flop 34, it permitted clock signals to pass through inverter 48 as activating signals to AI gate 45 and slow clock or frequency divider circuit 49. Clock signals from gate 45 are accumulated in delay counter 47.

Up to this point, an emitter pulse has enabled main counter 35 to accumulate a value which activates a decode circuit to 42 to generate a check start pulse. This, in turn, activates delay latch 38 to enable delay counter 47 to count up for a portion of the emitter pulse period. Decode circuit 42 is connected to the stages of maih counter 35 to produce its output only after the main counter has accumulated clock signals equal in time to approximately 97% or more of the nominal emitter period. Thereafter, the remainder of the emitter period is accumulated in delay counter 47. It will be seen from the description thus far that the count accumulated in delay counter 47 will reflect any variation in the emitter pulse period and will thus be a measure of the band velocity variation to be compensated.

When delay latch 38 is set by the next emitter pulse edge from OI, 37, AI gate 45 is blocked and counter 47 is no longer advanced or incremented. However, AI gate 46, already having one input conditioned by delay extend latch 44 being on, has a second input conditioned by latch 38 being set off, and pulses from slow clock 49 on line 51 begin to decrement or count down the value already accumulated. The slow clock is shown as a binary counter operating as a frequency divider. The desired frequency division is set by the connection of decode circuit 52. For example, the amount of delay per clock count can vary depending upon the band velocity. A reduction of 11:1 may be required at a high band velocity, whereas a reduction of 7:1 may be necessary at a slower velocity. Each slow clock pulse is delayed slightly at 53 to eliminate a race condition, and each delayed pulse clears the slow clock 49.

The decrementing of delay counter 47 is shown in waveform G in FIG. 3 as the downward slope from the peak count accumulation. Each peak value, of course, represents the relative length of the respective emitter period compared to a count representative of a nominal velocity represented by line 50. When delay counter 47 has been decremented to zero, as detected by decode circuit 54, delay extend latch 44 is reset, blocking AI gate 46. This prevents passing further slow clock pulses and issues a signal through OI 39, and AI gate 40, already conditioned by a Not Disable signal to OR gate 55 and the phase lock loop oscillator 26 in FIG. 1. The oscillator will begin the generation of its series of subscan pulses.

It will be seen from the foregoing description that the period of each emitter pulse is measured by a main counter and delay counter acting together. The delay counter is effective for only a brief time, and its registered count is representative of the duration of only a brief portion of the emitter period. In the example given, its count may represent variations of up to plus or minus 3% in the nominal velocity of the type band. The delay counter is decremented at a slower preset rate of whatever is required to correspond to the nominal band velocity.

The circuit of FIG. 2 has a precautionary secondary control at delay counter 47 which is decode circuit 56 that issues a signal upon detecting a predetermined high count limit. This limit signal is effective to reset delay latch 38 through OI 37 and allow the slow clock pulses from decoder 52 and delay 53 to begin decrementing the delay counter. The compensating circuit just described can be overridden by changing the Not Disable signal to the opposite level to disable decoder 42 and enable AI gate 57 to permit the phase lock loop oscillator to operate directly from the emitter pulses.

The compensating circuit of the invention has the ability to adjust the timing of the phase lock loop oscillator when the band velocity is either slow or fast with respect to the nominal velocity. It will be seen from the diagrams of FIG. 3 that the terminal portion of each emitter period is represented by the accumulated count in the delay counter 47. Count accumulations rising above line 50, representing the correct velocity, will indicate a slow band velocity and require a longer decrementing time to reach zero. Conversly, a count accumulation remaining below line 50 will indicate a band velocity faster than the nominal.

To assure that the phase lock loop oscillator 26 (FIG. 1) remains synchronized in the event the band velocity exceeds the limit below which the invention is effective, line 58 from edge detector flip-flop 34 provides a control signal. Normally, delay extend latch 44 is set on so that its off output at OR Invert 39 has an input level that renders the occurrence of the edge detection signal from flip-flop 34 ineffective. If delay extend latch 44 is off at the occurrence of the pulse from flip-flop 34, then the latter pulse is effective to cause OR Invert 39 to produce a high level signal to AND 40 that provides a high level signal to OR Invert 55 that, in turn, produces a negative-going output to initiate operation of the phase lock loop.

While the invention has been particularly shown and described with reference to preferred embodiment thereof, it will be understood by those skilled in the art that changes in form and details may be made therein without departing from the spirit and scope of the invention.

What is claimed is:

1. In a printing device having a moving carrier present type characters at different print positions along a print line of a recording medium and having means for generating a succession of timing signals synchronized with the displacement of said carrier, apparatus for providing an output signal compensating for variations in the velocity of said carrier comprising:

means for generating first clock pulses at a first frequency and second clock pulses at a second frequency;

means responsive to a said timing signal for accumulating said first clock pulses as a representation of the duration of the period of said timing signal;

said accumulating means including first counter means for accumulating said first clock pulses to a predetermined quantity and second counter means for accumulating said first clock pulses for the duration of said timing signal period;

decrementing means operable in response to the next succeeding timing signal for applying said second clock pulses to said second counter means to reduce the accumulated value thereof to a predetermined value; and means responsive to said predetermined value for issuing a said output signal.

2. Apparatus as described in claim 1 wherein the accumulated value in said second counter can be either larger or smaller values than that representing a nominal duration of a said timing signal period.

3. Apparatus as described in claim 2 wherein the accumulated value of said second counter means at the occurrence of said next timing signal is decremented to zero by said second clock pulses.

4. Apparatus as described in claim 1 wherein said decrementing means is operable to apply said second clock pulses to only said second counter means.

5. In a printing device having a moving carrier present type characters at different print positions along a print line of a recording medium and having means for generating a succession of timing signals synchronized with the displacement of said carrier, apparatus for providing an output signal compensating for variations in the velocity of said carrier comprising:

means for generating first clock pulses at a first frequency and second clock pulses at a second frequency;

means responsive to a said timing signal for accumulating said first clock pulses as a representation of the duration of the period of said timing signal;

said accumulating means including means responsive to a preselected value for preventing further accumulation;

decrementing means operable in response to the next succeeding timing signal for applying said second clock pulses to said accumulating means to reduce the accumulated value thereof to a predetermined value; and means responsive to said predetermined value for issuing a said output signal.

6. In a printing device having a moving carrier present type characters at different print positions along a print line of a recording medium and having means for generating a succession of timing signals synchronized with the displacement of said carrier, apparatus for providing an output signal compensating for variations in the velocity of said carrier comprising:

means for generating first clock pulses at a first frequency and second clock pulses at a second frequency;

said second clock pulses occurring at a frequency lower than said first clock pulses;

means responsive to a said timing signal for accumulating said first clock pulses as a representation of the duration of the period of said timing signal;

decrementing means operable in response to the next succeeding timing signal for applying said second clock pulses to said accumulating means to reduce the accumulated value thereof to a predetermined value; and means responsive to said predetermined value for issuing a said output signal.

7. Apparatus as described in claim 6 wherein the frequency of said second clock pulses is a sub-multiple of the frequency of said first clock pulses.

8. In printing apparatus having a carrier movable to present type characters at different print positions along a print line of a recording medium and having means for generating recurring timing signals synchronized with the motion of said carrier, apparatus for providing an output signal compensating for variations in the velocity of said carrier comprising:

means for generating a first series of clock pulses at a first frequency and a second series of clock pulses at a second frequency;

counter means operable by a first control signal to count incrementally clock pulses of said first series and responsive to a second control signal to count decrementally clock pulses of said second series;

means responsive to a first said timing signal for generating a first control signal from a predetermined time after said first timing signal until the next succeeding timing signal to accumulate from an origin a value in said counter means representative of the duration of the interval between said two timing signals from said first clock pulses;

means responsive to said next succeeding timing signal for generating a said second control signal for operating said counter means decrementally toward said origin with said second clock pulses; and means responsive to said counter means reaching said origin for producing a said output signal at a time after said next timing signal proportional to the period of the preceding timing signal.

9. Apparatus as described in claim 8 wherein said counter means includes a first counter for counting said first clock pulses for defining said predetermined time.

10. In printing apparatus having a type carrier movable to present type characters to different print positions along a print line of a document and having means for generating timing signals in synchronism with the motion of said type carrier, an arrangement for compensating for variations in the velocity of said type carrier comprising:

a source of high-speed clock pulses and slow-speed clock pulses;

first counter means activated by a first of said timing signals to count said high-speed clock pulses;

delay counter means having inputs for counting up and down;

means responsive to a predetermined count condition of said first counter means for generating a check start signal;

first delay latch means responsive to said check start signal for gating said high speed clock pulses to the count up input of said delay counter means and to a second of said timing pulses for degating said high-speed clock pulses to the count up input of said delay counter means and for generating an end delay signal;

second delay latch means responsive to said check start signal for producing an output signal;

means responsive to said output signal and said delay signal for gating said slow clock pulses to the count down input of said delay counter means;

means to responsive to a zero condition of said delay counter means for resetting said second delay latch means whereby said output signal is dropped; and means responsive to the dropping of said output signal for transmitting a print control signal to said printer.

* * * * *